US010940983B2

(12) United States Patent
Paganuzzi

(10) Patent No.: US 10,940,983 B2
(45) Date of Patent: Mar. 9, 2021

(54) CLOSURE CAPSULE

(71) Applicant: BORMIOLI PHARMA S.R.L., Milan (IT)

(72) Inventor: Valerio Paganuzzi, Parma (IT)

(73) Assignee: BORMIOLI PHARMA S.P.A., Milan (IT)

( * ) Notice: Subject to any disclaimer, the term of this patent is extended or adjusted under 35 U.S.C. 154(b) by 127 days.

(21) Appl. No.: 16/086,845

(22) PCT Filed: Jan. 31, 2017

(86) PCT No.: PCT/IB2017/050506
§ 371 (c)(1),
(2) Date: Sep. 20, 2018

(87) PCT Pub. No.: WO2017/168263
PCT Pub. Date: Oct. 5, 2017

(65) Prior Publication Data

US 2019/0119016 A1 Apr. 25, 2019

(30) Foreign Application Priority Data

Mar. 31, 2016 (IT) ..... 102016000032998

(51) Int. Cl.
*B65D 51/28* (2006.01)

(52) U.S. Cl.
CPC ..... *B65D 51/285* (2013.01); *B65D 51/2842* (2013.01); *B65D 2215/02* (2013.01); *B65D 2401/20* (2020.05); *B65D 2401/25* (2020.05)

(58) Field of Classification Search
CPC ..... B65D 51/285; B65D 51/2842; B65D 2401/25; B65D 2401/20; B65D 2215/02
(Continued)

(56) References Cited

U.S. PATENT DOCUMENTS 3,840,136 A * 10/1974 Lanfranconi ..... B65D 51/226 215/6
3,968,872 A * 7/1976 Cavazza ..... B65D 47/18 206/222

(Continued)

FOREIGN PATENT DOCUMENTS

CN 1827482 9/2006
CN 201437438 4/2010

(Continued)

*Primary Examiner* — J. Gregory Pickett
*Assistant Examiner* — Jenine Pagan
(74) *Attorney, Agent, or Firm* — Pearne & Gordon LLP

(57) ABSTRACT

A closure capsule for closing a container, comprising: —a cap (2) to be associated with a container and comprising a frangible mouth (20); —a cutter (3) comprising a cutting edge (30) designed to open said frangible mouth (20); at least the cap (2) and the cutter (3) in combination defining a reservoir (8) for containing a substance to be dropped into the container when the frangible mouth (20) is opened; —a protective covering (4) for the cap (2) and the cutter (3), separate from the cutter (3) and, in turn, comprising: i) a lateral wall (40) that encloses a zone (402) for at least partially housing the cutter (3); ii) a base (41) from which said lateral wall (40) extends; —transmitting means (5) for transmitting an opening torque, from the covering to the cutter, for opening the frangible mouth (20), said transmitting means (5) comprising a first and a second portion (51, 52) incorporated in the covering (4) and in the cutter (3), respectively; said first portion (51) being incorporated in the base (41).

12 Claims, 2 Drawing Sheets

(58) Field of Classification Search
USPC ..... 206/219, 222
See application file for complete search history.

(56) References Cited

U.S. PATENT DOCUMENTS

| | | | | |
|---|---|---|---|---|
| 4,330,067 | A | 5/1982 | Deussen | |
| 5,465,835 | A * | 11/1995 | Schumacher | B65D 81/3222 206/221 |
| 6,148,996 | A | 11/2000 | Morini | |
| 6,387,073 | B1 * | 5/2002 | Weiler | A61J 1/2093 206/222 |
| 7,748,550 | B2 | 7/2010 | Cho | |
| 8,672,154 | B2 | 3/2014 | Seelhofer | |
| 2005/0161348 | A1 * | 7/2005 | Morini | B65D 41/3438 206/219 |
| 2006/0071000 | A1 | 4/2006 | Weist et al. | |
| 2006/0108135 | A1 | 5/2006 | Cho | |
| 2006/0108314 | A1 | 5/2006 | Cho | |
| 2007/0280042 | A1 | 12/2007 | Yamanaka | |
| 2008/0223485 | A1 | 9/2008 | Nyambi et al. | |
| 2010/0282624 | A1 | 11/2010 | Paganuzzi | |
| 2010/0288767 | A1 | 11/2010 | Seelhofer | |
| 2011/0290824 | A1 * | 12/2011 | Smith | B65D 51/2864 222/135 |
| 2013/0292275 | A1 * | 11/2013 | Smart | B65D 51/2835 206/222 |
| 2014/0048507 | A1 | 2/2014 | Brambilla et al. | |
| 2014/0203043 | A1 | 7/2014 | Yamanaka | |
| 2016/0264323 | A1 * | 9/2016 | Jeon | B65D 51/285 |

FOREIGN PATENT DOCUMENTS

| | | | |
|---|---|---|---|
| CN | 101945813 | | 1/2011 |
| WO | 9962775 | | 12/1999 |
| WO | 2008123750 | A2 | 10/2008 |
| WO | 2009031864 | A2 | 3/2009 |
| WO | 2012153206 | A1 | 11/2012 |
| WO | 2015101925 | A1 | 7/2015 |

* cited by examiner

CLOSURE CAPSULE

TECHNICAL FIELD

The present invention relates to a closure capsule for closing a container, a container with the capsule associated thereto and an opening method of the container.

BACKGROUND ART

A closure capsule for closing a container is known, comprising:

a cap that can be associated with the container and comprising a frangible mouth;

a cutter projecting internally of said cap and which is free to translate along the cap; the cutter comprises a cutting edge designed to open the frangible mouth; the cap and the cutter in combination defining a reservoir for containing a substance to be dropped into the reservoir when the frangible mouth is opened;

a covering having an overturned-beaker profiling that protects the cap and the cutter. The covering is connected to the container by means of a threaded coupling.

The substance contained in the reservoir prior to opening must mix with the liquid present in the container following the rupturing action of the frangible mouth.

For this purpose the user, by exploiting this threaded coupling, screws the covering onto the container; consequently the covering roto-translates towards the container, axially pushing the cutter against the frangible mouth and causing the opening thereof.

A drawback of this constructional solution is linked to the effort that has to be applied on the covering so as to determine the effective cutting of the frangible mouth.

The capsules disclosed by US2006/071000, WO2009/031864, WO2012/153206 are well known.

DISCLOSURE OF THE INVENTION

In this context an aim of the present invention is to make available a closure capsule which enables facilitating the mixing of the substance present in the reservoir with the liquid present in the container and which at the same time is perfectly compatible with already-existing production lines.

The stated technical task and specified objects are substantially achieved by a closure capsule comprising the technical features disclosed in one or more of the appended claims.

BRIEF DESCRIPTION OF DRAWINGS

Further characteristics and advantages of the present invention will become more apparent from the following indicative, and hence non-limiting, description of a preferred, but not exclusive, embodiment of the closure capsule, as illustrated in the appended drawings, in which.

DETAILED DESCRIPTION OF PREFERRED EMBODIMENTS OF THE INVENTION

Figure 1:
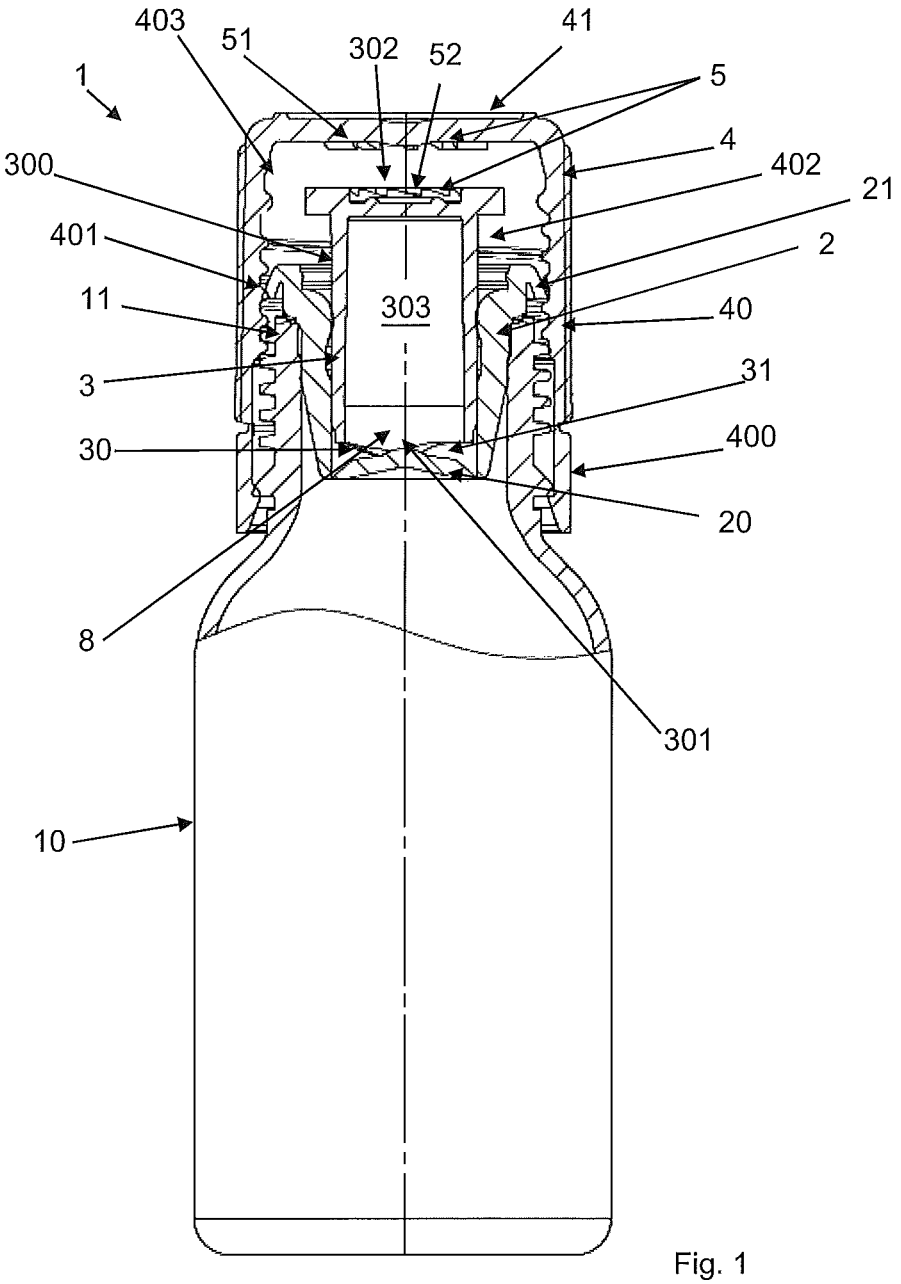
FIG. 1 shows a section view of a container and a capsule according to the present invention.

In the appended figures, reference number 1 denotes a closure capsule of a container.

The capsule 1 comprises a cap 2 that can be associated with a container and comprising a frangible mouth 20.

The capsule 1 comprises a cutter 3. The cutter 3 comprises a cutting edge 30 designed to open said frangible mouth 20. At least the cap 2 and the cutter 3 define, in combination, a reservoir 8 for containing a substance destined to be dropped into the container, on the opening of the frangible mouth 20 (in the solution given by way of example the reservoir 8 is defined by the combination of the cutter 3 and the cap 2). The substance is typically a powder, but might also be a liquid. When the substance falls into the container the mixing between the substance present in the reservoir 8 and the product present in the container takes place so that the desired amount can be administered. As shown by way of example in the appended figures, the cutter 3 projects internally of the cap 2. The cap 2 thus defines an axial guide for the cutter. In particular the cap 2 surrounds at least a portion of the cutter 3 by 360°. When the frangible mouth 20 is intact, the cap 2 is shaped as an element defining a concavity partially housing the cutter 3.

The cutter 3 is appropriately shaped as a hollow body. It therefore comprises an internal cavity 303.

In particular the cutter 3 comprises a tank 300 at a first end 301 of which the cutting edge 30 is present. At the first end 301 the internal cavity 303 is placed in communication with the outside of the cutter 3. At the second end 302 of the tank 300 the cutter 3 comprises a wall 304 which occludes the cavity 303.

The capsule 1 comprises a covering 4 that protects the cap 2 and the cutter 3. The covering 4 is distinct from the cutter 3. The covering 4 in turn comprises:

i) a lateral wall 40 that encloses a zone 402 for at least partially housing the cutter 3; the lateral wall 40 is preferably substantially cylindrical;

ii) a base 41 from which said lateral wall 40 extends.

The capsule 1 comprises transmitting means 5 for transmitting an opening torque from the covering to the cutter 3 for opening the frangible mouth 20. The opening torque is exerted by a user at the moment when it is desired to mix the substance present in the reservoir 8 and the liquid present in the container. This occurs before first use. The transmitting means 5 when enmeshed enables a solidly rotational-translational movement of the covering 4 and of the cutter 3.

The transmitting means 5, if enmeshed, thus enables the transmission of the opening torque of the frangible mouth 20 without relative sliding to between the covering 4 and the cutter 3. This facilitates the transmission of the torque between the covering 4 and the cutter 3.

The cap 2 appropriately comprises a circumferential flexible lip 21 which tends to spontaneously open in a radial direction, anchoring in a seating 403 of the covering 4 at the end of an inserting run of the cutter 3 in the cap 2.

The transmitting means 5 comprises a first and a second portion 51, 52 located one in front of another and respectively incorporated in the covering 4 and in the cutter 3. In particular the first portion 51 is incorporated in the base 41 of the covering 4.

The first and second portions 51, 52 are movable between a first position, in which they are engaged to each other so as to enable transmission of the opening torque, from the covering 4 to the cutter 3, for opening the frangible mouth 20, and a position in which they are set apart from each other and in which the transmitting means 5 is disengaged.

Figure 2:
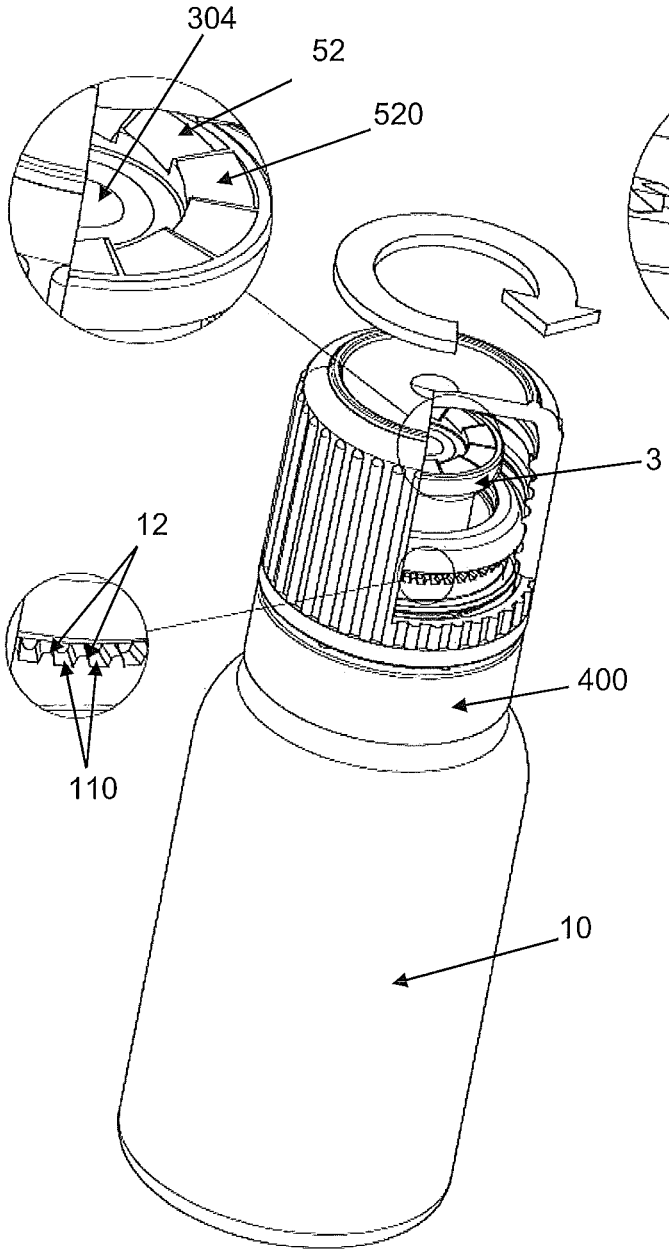
FIGS. 2 and 3 show two partly-interrupted perspective views comprising a capsule according to the present invention.
Figure 3:
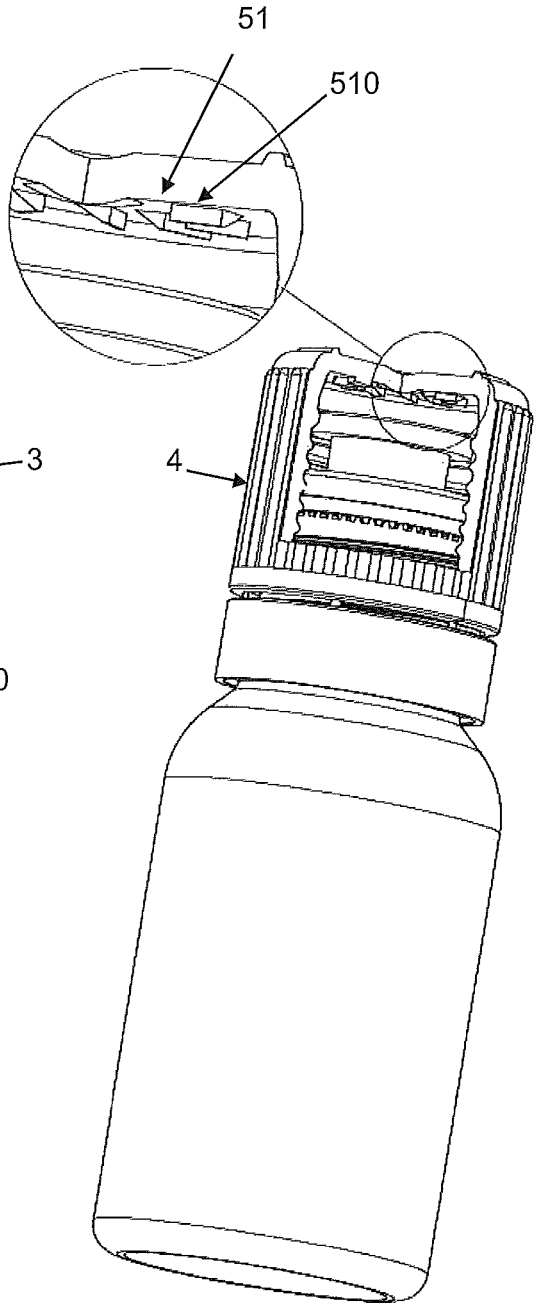

In the preferred solution, initially the first and the second portion 51, 52 are disengaged (see for example FIGS. 1, 2, 3). The user applies a screwing torque of the capsule 1 on the container and this leads the transmitting means 5 to engage to one another. At this point a further screwing torque defines the above-indicated opening torque of the mouth 20.

The transmitting means 5 comprises a first set 510 of teeth fashioned in said first portion 51 and a second set 520 of teeth fashioned in said second portion 52. By way of example, the teeth of the first and/or the second set 510, 520 have a triangular prism shape. The triangular prism preferably has a right-angled triangle as a base.

The teeth of the first and/or the second set 510, 520 are arranged in a crown-fashion (in particular they follow one another along a circumference).

With reference to the foregoing, the second portion 52 is located at the second end 302 of the tank 300 of the cutter 3.

The covering 4 is connectable to a container by means of a thread. For this purpose the covering 4 comprises a thread 401 having a pitch. The height of the cutting edge 30 is lower than the pitch of the thread 401 of the covering 4. This enables preventing a small disc deriving from the opening of the frangible mouth 20 from dropping internally of the container. In fact in this mode the cutting edge will open the frangible mouth 20 along an arc of less than 360°, in particular comprised between 250° and 300°. This prevents complete detachment of the small disc, which thus remains connected to the remaining parts of the cap 2.

The cutting edge comprises two strips converging in a pointed zone. The cutting edge 30 (in particular one of the two strips mentioned in the foregoing) defines a concavity 31, which, upon completion of the opening of the frangible mouth 20, partly receives a small disc that projects in a cantilever fashion and that results from the partial opening of the frangible mouth 20. This detail also causes the cutting edge to receive the already-cut portion of the frangible mouth 20 and not interfere with it. This further reduces the risk that the small disc might entirely detach, creating an obstacle that might compromise correct functioning. One of the two strips is advantageously profiled in an arc of circle shape, having a radius that differs from the radius of the small disc by less than 10%.

It is important that the first and the second set 510, 520 of teeth reciprocally engage prior to an axial thrust of the second set 520 on the cutter 3. To obtain the above, the height of the second set 520 of teeth is advantageously greater than the pitch of the thread 401.

The covering 4 advantageously comprises an intactness band 400 that is made of a first plastic material which is more deformable with respect to a second plastic material of which said cutter 3 is made. This enables, during the application of a screwing torque of the covering 4 on the container, the breaking of the intactness band 400 without damaging the cutter 3.

The capsule 1 appropriately comprises anti-rotation teeth 12 destined to interact with a container on which the cap is applied. This is to prevent the cap 2 from being drawn in rotation by the cutter 3 due to friction. The intactness band 400 is located at an opposite end with respect to the base 41.

The object of the present invention is also a system comprising:

a container 10 comprising a mouthpiece 11;

a capsule 1 having one or more of the characteristics described above.

The cap 2 of the capsule 1 is applied to a mouth 11 of the container 10. The cap 2 further comprises anchoring means of the mouthpiece which opposes the drawing in rotation of the cap 2 by action of the cutter 3. For example the anchoring means comprises a plurality of anti-rotation teeth 12 which interlock in corresponding seats 110 fashioned in said mouthpiece 11. The anchoring means might however comprise, additionally or alternatively, seats destined to receive projections fashioned on the mouthpiece 11.

The container 10 advantageously comprises a broadening located downstream of a neck in which the mouthpiece is fashioned. This broadening determines the rupture of the intactness band 400 following a thrust thereon exerted by the screwing of the covering 4 on the container 10.

A further object of the present invention is a method for opening a container 10 having a mouthpiece 11 occluded by a capsule 1 having one or more of the characteristics described hereinabove. The method conveniently comprises the steps of:

screwing the covering 4 on the container 10, drawing the cutter 3 into rotational-translational movement so as to open the frangible mouth 20 and drop the substance present in the reservoir 8 into the container 10;

unscrewing the covering 4 from the container 10.

The step of unscrewing the covering 4 from the container 10 is achieved by drawing the extraction of the cutter 3 and the cap 2 from the container 10.

A method for producing a capsule according to the present invention comprises following steps:

inserting a substance internally of the cavity 303 afforded in the cutter 3;

inserting the cutter 3 and the substance contained in the cavity 303 internally of the cap 2;

inserting the cutter 3 and the cap 2 internally of the covering 4.

This method for producing includes the use of assembly plants of known type and this enables recycling a plant of known type used for realising a capsule of the type described in WO2012/153206.

The invention thus conceived makes it possible to achieve multiple advantages.

Firstly it enables reducing the force necessary for a user to determine the dropping of the substance present in the reservoir 8 internally of the container. Secondly, it enables using, for the assembly of the capsule, plants already in use by many users without any need to make fresh investments so as to modify the plants.

The invention as it is conceived is susceptible to numerous modifications, all falling within the scope of the inventive concept characterising it. Further, all the details can be replaced with other technically-equivalent elements. In practice, all the materials used, as well as the dimensions, can be any according to requirements.

The invention claimed is:

1. A closure capsule for closing a container, comprising:

a cap (2) that can be associated with a container and comprising a frangible mouth (20);

a cutter (3) comprising a cutting edge (30) designed to open said frangible mouth (20); at least said cap (2) and said cutter (3) in combination defining a reservoir (8) for containing a substance to be dropped into the container when the frangible mouth (20) is opened;

a covering (4) that protects the cap (2) and the cutter (3); said covering (4) being separate from the cutter (3) and, in turn, comprising:

i) a lateral wall (40) that encloses a zone (402) for at least partially housing the cutter (3);

ii) a base (41) from which said lateral wall (40) extends;

a first and a second portion (51, 52) respectively incorporated in the covering (4) and in the cutter (3) for transmitting an opening torque from the covering to the cutter for opening the frangible mouth (20); said first portion (51) being incorporated in the base (41); characterized in that the first and the second portion (51, 52), when enmeshed, enables a solidly rotational-translational movement of the covering (4) and of the cutter (3).

2. The capsule according to claim 1, characterized in that said first and second portions (51, 52) are movable between a first position, in which they are engaged to each other so as to enable transmission of the opening torque, from the covering (4) to the cutter (3), for opening the frangible mouth (20), and a position in which they are set apart from each other and in which the transmitting means (5) is disengaged.

3. The capsule according to claim 1, characterized in that the transmitting means (5) comprises a first set (510) of teeth afforded in said first portion (51) and a second set (520) of teeth afforded in said second portion (52).

4. The capsule according to claim 1, characterized in that the cutting edge (30) defines a concavity (31), which, upon completion of the opening of the frangible mouth (20), partly receives a small disc that projects in a cantilever fashion and that results from the partial opening of the frangible mouth (20).

5. The capsule according to claim 1, characterized in that the covering (4) comprises a thread (401) having its own pitch and that is suitable for connecting the covering (4) to a container; the height of the cutting edge (30) being lower with respect to the pitch of the thread (401) of the covering (4).

6. The capsule according to claim 3, characterized in that the covering (4) comprises a thread (401) having its own pitch and that is suitable for connecting the covering (4) to a container; the height of the cutting edge (30) being lower with respect to the pitch of the thread (401) of the covering (4).

7. The capsule according to claim 1, characterized in that the covering (4) comprises an intactness band (400) that is made of a first plastic material which is more deformable with respect to a second plastic material of which said cutter (3) is made.

8. The capsule according to claim 3, characterized in that the covering (4) comprises a thread (401) having its own pitch and that is suitable for connecting the covering (4) to a container; the height of the cutting edge (30) being lower with respect to the pitch of the thread (401) of the covering (4).

9. The capsule according to claim 6, wherein the height of the second set (520) of teeth is higher with respect to the pitch of the thread (401).

10. A system comprising:

a container (10) comprising a mouthpiece (11);

a capsule according to claim 1, said cap (2) of said capsule (1) being applied to the mouthpiece (11) of the container (10).

11. The system according to claim 10, characterized in that said cap (2) comprises a plurality of anti-rotation teeth (12) that interlock in respective seats (110) afforded in said mouthpiece (11).

12. A method for opening a container, characterized in that it comprises the steps of:

providing a container having a mouthpiece occluded by a capsule according to claim 1;

screwing the covering (4) on the container, drawing the cutter (3) into rotational-translational movement so as to open the frangible mouth (20) and drop the substance present in the reservoir (8) into the container;

unscrewing the covering (4) from the container (10), the step of unscrewing the covering (4) from the container (10), thus drawing and thereby bringing about the extraction of the cutter (3) and the cap (2) from the container (10).

* * * * *